US008178771B2

(12) United States Patent
Ando

(10) Patent No.: US 8,178,771 B2
(45) Date of Patent: May 15, 2012

(54) CASING STRUCTURE FOR SOUND ADJUSTING APPARATUS

(75) Inventor: Takeshi Ando, Hamamatsu (JP)

(73) Assignee: Yamaha Corporation (JP)

( * ) Notice: Subject to any disclaimer, the term of this patent is extended or adjusted under 35 U.S.C. 154(b) by 184 days.

(21) Appl. No.: 12/692,028

(22) Filed: Jan. 22, 2010

(65) Prior Publication Data

US 2010/0188822 A1 Jul. 29, 2010

(30) Foreign Application Priority Data

Jan. 23, 2009 (JP) ..... 2009-012654

(51) Int. Cl.
*G10H 1/32* (2006.01)

(52) U.S. Cl. ..... 84/644; 84/718

(58) Field of Classification Search ..... 84/644
See application file for complete search history.

(56) References Cited

U.S. PATENT DOCUMENTS

| | | | | |
|---|---|---|---|---|
| 5,402,501 | A * | 3/1995 | Silfvajt et al. | 381/119 |
| 6,057,829 | A * | 5/2000 | Silfvast | 345/156 |
| 6,679,358 | B2 * | 1/2004 | Be | 190/18 A |
| 2005/0217926 | A1 * | 10/2005 | Murata | 181/156 |

FOREIGN PATENT DOCUMENTS

JP 3818248 B2 9/2006

OTHER PUBLICATIONS

Mackie Digital X Bus [online], Dec. 21, 2008 [retrieved Sep. 13, 2011], Retrieved from http://www.mackie.com/products/digitalxbus/index.html, pp. 1-2.*

* cited by examiner

*Primary Examiner* — Elvin G Enad
*Assistant Examiner* — Christopher Uhlir
(74) *Attorney, Agent, or Firm* — Rossi, Kimms & McDowell LLP

(57) ABSTRACT

Casing structure for a mixer apparatus includes a box-shaped casing that comprises an upper surface section, a bottom surface section and a side surface section. The upper surface section, having a generally obtuse-angled "V" shape, includes: a flat operation panel having operating members; a boundary section located adjacent to the rear end edge of the operation panel; and a flat, inclined display panel extending rearwardly and upwardly from the boundary section at a greater inclination angle than the operation panel. Within the casing, a partition member is provided on the bottom surface section to extend vertically upward to the boundary section, and it has openings to permit communication between front and rear accommodating sections. The partition member supports the boundary section from below to reinforce the upper surface section.

4 Claims, 5 Drawing Sheets

CASING STRUCTURE FOR SOUND ADJUSTING APPARATUS

BACKGROUND

The present invention relates to a casing structure suited for application to sound adjusting apparatus, such as large-size mixer apparatus.

Casing structures for sound adjusting apparatus, such as a mixer apparatus, are known, one example of which is disclosed in Japanese Patent No. 3818248 (hereinafter referred to as "the patent literature"). Casing structures of this type include a box-shaped casing defined by an upper surface section on which are provided a display and a multiplicity of operating members (operators), a side surface section and a bottom wall section to be placed on a table, floor or the like of an installation site.

In the casing structure for a sound adjusting apparatus disclosed in the patent literature, the flat upper surface section has an almost uniform ascent or inclination angle such that it slightly slants upward from the front end to rear end of the casing and has a shape that does not greatly vary in thickness (height) from the front end to rear end. With such a structure, the casing has to have, over an entire length in a front-rear direction, a great height corresponding to a component having the greatest height among components to be installed within the case. Thus, the casing would undesirably have a great overall height and hence a great volume.

In order to improve an outer appearance design and reduce a necessary installation space of the mixer apparatus, it is required to minimize the thickness (or height) of the casing and thereby enhance operability of operating members and visibility of a display of the mixer apparatus, Therefore, there is a need for a casing structure which can have a reduced thickness (height) while securing good operability of the operating members and good visibility of the display. Further, because a large-size mixer apparatus generally has a great weight, the casing has to have a strength enough to avoid deformation etc. during transportation even where it has a reduced thickness.

Further, because the casing in the conventionally-known mixer apparatus has an appropriate thickness over the entire length in the front-rear direction, it has a sufficient accommodating space (volume) for installation therein heat-producing components, such as a substrate and power supply circuit. Thus, flows of air can be readily produced through air holes and an air sucking fan, so that a necessary heat radiation performance of the heat-producing components, such as a substrate and power supply circuit, can be secured. However, with the reduction in thickness of the casing, the interior volume of the casing would decrease. Thus, depending on the shape of the casing, the components installed in the accommodating space would hinder formation of air flows, which may undesirably reduce heat radiation from the heat producing components. For these reasons, in the case where the casing is reduced in thickness, head radiation performance of the heat producing components must also be taken into account.

SUMMARY OF THE INVENTION

In view of the foregoing, it is an object of the present invention to provide an improved casing structure for a sound adjusting apparatus which permits reduction in thickness of a casing even where the sound adjusting apparatus is of a large size, which can secure a sufficient heat radiation performance of heat-producing components within the casing and sufficient strength of the casing, and which permits a superior operability of operating members and a superior visibility of a display.

In order to accomplish the above-mentioned object, the present invention provides an improved casing structure for a sound adjusting apparatus, the casing structure including a box-shaped casing which comprises: an upper surface section having a display and operating members disposed thereon; a bottom surface section; and a side surface section surrounding side surfaces connecting between the upper surface section and the bottom surface section. The upper surface section includes: a generally flat operation panel section that has a multiplicity of the operating members provided on a front side region of the casing; a boundary section that connects from a rear end edge of the operation panel section; and a generally flat, inclined display panel section that extends rearwardly and upwardly from the boundary section at a greater inclination angle than the operation panel section. The casing including in the interior thereof: a front accommodating section defined between the operation panel section and the bottom surface section; a rear accommodating section defined between the display panel section and the bottom surface section; and a plate-shaped partition member that is provided on the bottom surface section to extend vertically upward from the bottom surface section to the boundary section, the partition member having an opening formed therethrough to permit communication between the front accommodating section and the rear accommodating section. The partition member supports the boundary section from below to reinforce the boundary section and other components around the boundary section.

In the casing structure of the present invention, the upper surface section of the casing includes the flat operation panel section having the multiplicity of the operating members provided thereon, the boundary section located adjacent to the rear end edge of the operation panel section, and the flat display panel section having the display and extending obliquely upward from the boundary section toward the rear of the casing. Thus, the casing structure of the present invention can reduce the thickness of the casing, particularly the thickness of the front side region of the casing where the flat operation panel section is provided, and thus can reduce the volume of the casing. Further, because the plate-shaped partition member is provided under the boundary section and supports and reinforces the boundary section from below, the casing structure of the present invention can increase the strength of the casing. Further, the partition member has an opening formed therethrough to permit communication between the front accommodating section and the rear accommodating section, and the opening of the partition member can promote air flows in the front and rear accommodating sections, so that the present invention can secure a sufficient heat radiation performance of heat-producing components within the casing. Further, because the display panel section is installed on a rear side region of the casing at a greater inclination angle than the operation panel section, the casing structure of the present invention can secure both good operability of the operating members provided on the operation panel section and good visibility of the display provided on the display panel section. As a result, the casing structure of the present invention can significantly enhance the usability of the sound adjusting apparatus.

Preferably, a heat-producing component installing section for installing heat producing components, such as a power supply section, within the casing is provided in the rear accommodating section. Because the display panel section is provided at a greater inclination angle than the operation panel section, the rear accommodating section has a greater interior height and hence a greater interior volume than the front accommodating section. Thus, by the heat producing components being disposed in the rear accommodating section within the casing, the casing structure of the present invention can secure a sufficient heat radiation performance of the heat producing components.

Preferably, the operation panel section is disposed generally in parallel to the bottom surface section. Thus, in a case where the sound adjusting apparatus is installed with the bottom surface section of the casing placed on a horizontal surface of an installation site, the operation panel section lies in the horizontal plane. Consequently, sliding-type operating members, such as fader operators, provided on the operation panel section can be operated in the horizontal plane, which allows a user or human operator to operate the operating members with utmost ease. Further, because the operation panel section extends in parallel to the bottom surface section while the display panel section, provided rearwardly of the operation panel section, extends obliquely upward toward the rear of the casing, the casing structure of the present invention can secure both good operability of the operating members provided on the operation panel section and good visibility of the display provided on the display panel section.

Preferably, the operation panel section and the operating members provided on the operation panel section are mounted on an operation panel mounting unit disposed on a front side region of the upper surface section, and the operation panel mounting unit is pivotable about a pivot point, located forwardly of the boundary section, to open or close the front accommodating section. With such pivoting movement of the operation panel mounting unit, opening/closing of the front accommodating section can be executed with ease. Thus, the casing structure of the present invention allows the user or human operator to readily access the components accommodated in the front accommodating section and thereby can facilitate maintenance of the sound adjusting apparatus.

Preferably, the casing structure of the present invention is constructed in such a manner that, as the operation panel mounting unit is caused to pivot about the pivot point to close the front accommodating section, the rear end edge of the operation panel section abuts against the partition member so that the operation panel mounting unit is positioned in a predetermined closed position. Thus, as the operation panel mounting unit is moved to close the front accommodating section, the operation panel can be accurately positioned and held in a predetermined position.

The casing structure for a sound adjusting apparatus constructed in the aforementioned manner can effectively reduce the thickness of the casing even where the sound adjusting apparatus is of a large size, can secure a sufficient heat radiation performance of the heat-producing components within the casing and sufficient strength of the casing, and also permits an enhanced operability of the operating members and enhanced visibility of the display.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION

Figure 1A:
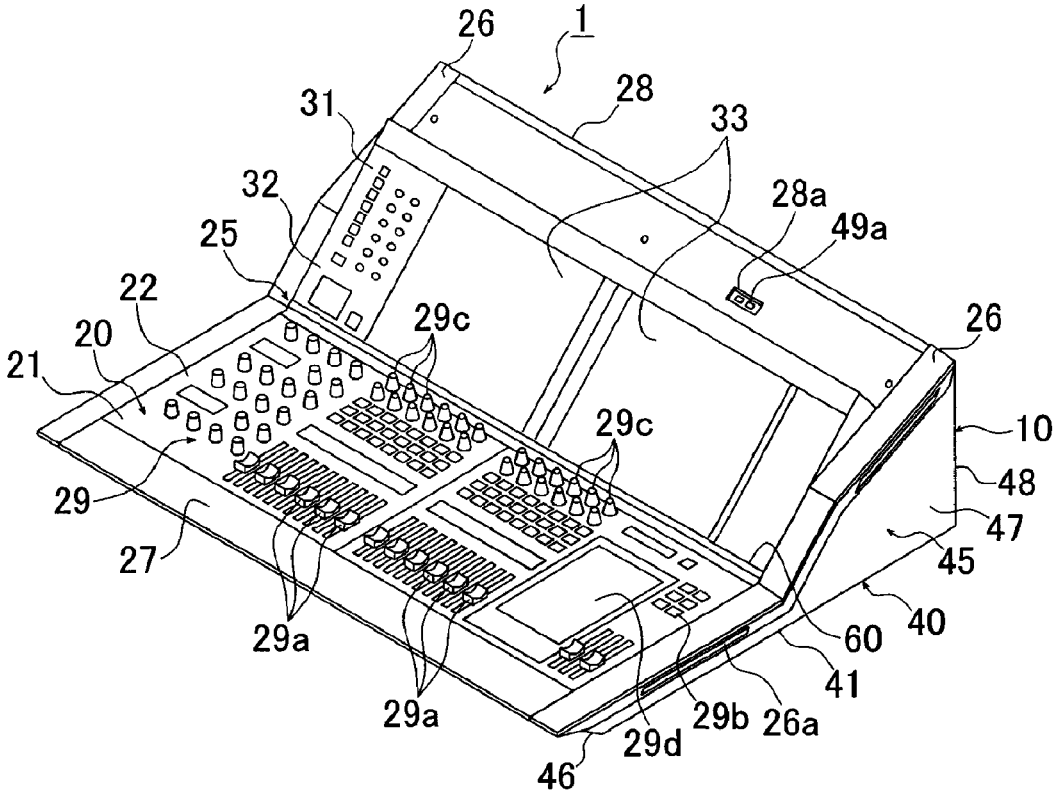
FIG. 1A is a perspective view showing an outer appearance of a mixer apparatus to which is applied a casing structure according to an embodiment of the present invention.
Figure 1B:
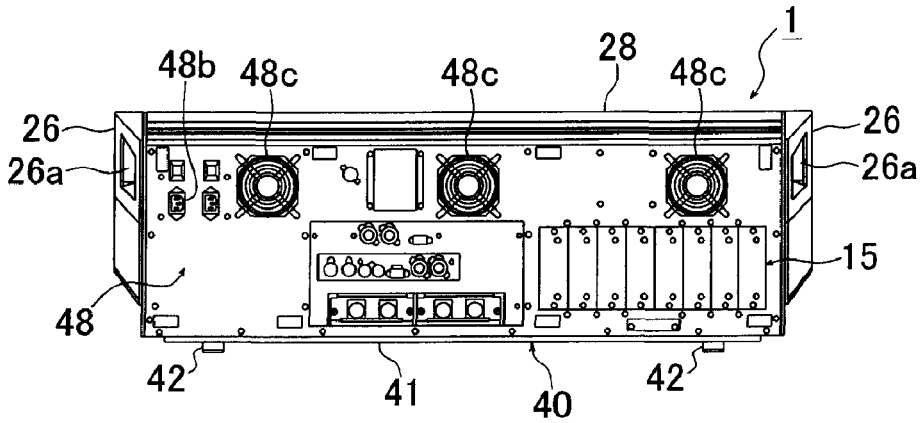
FIG. 1B is a rear view of the mixer apparatus.
Figure 2:
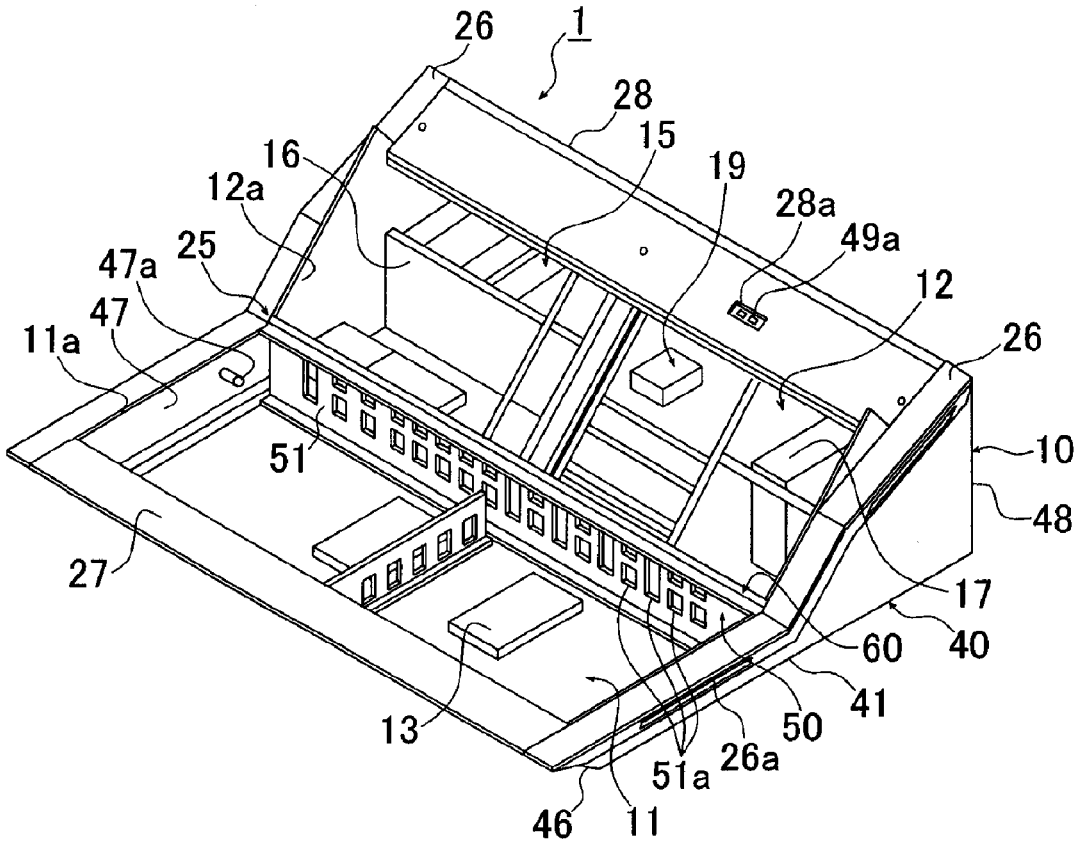
FIG. 2 is a perspective view showing the casing structure of the mixer apparatus with an operation panel mounting unit and a display mounting unit removed therefrom.
Figure 3:
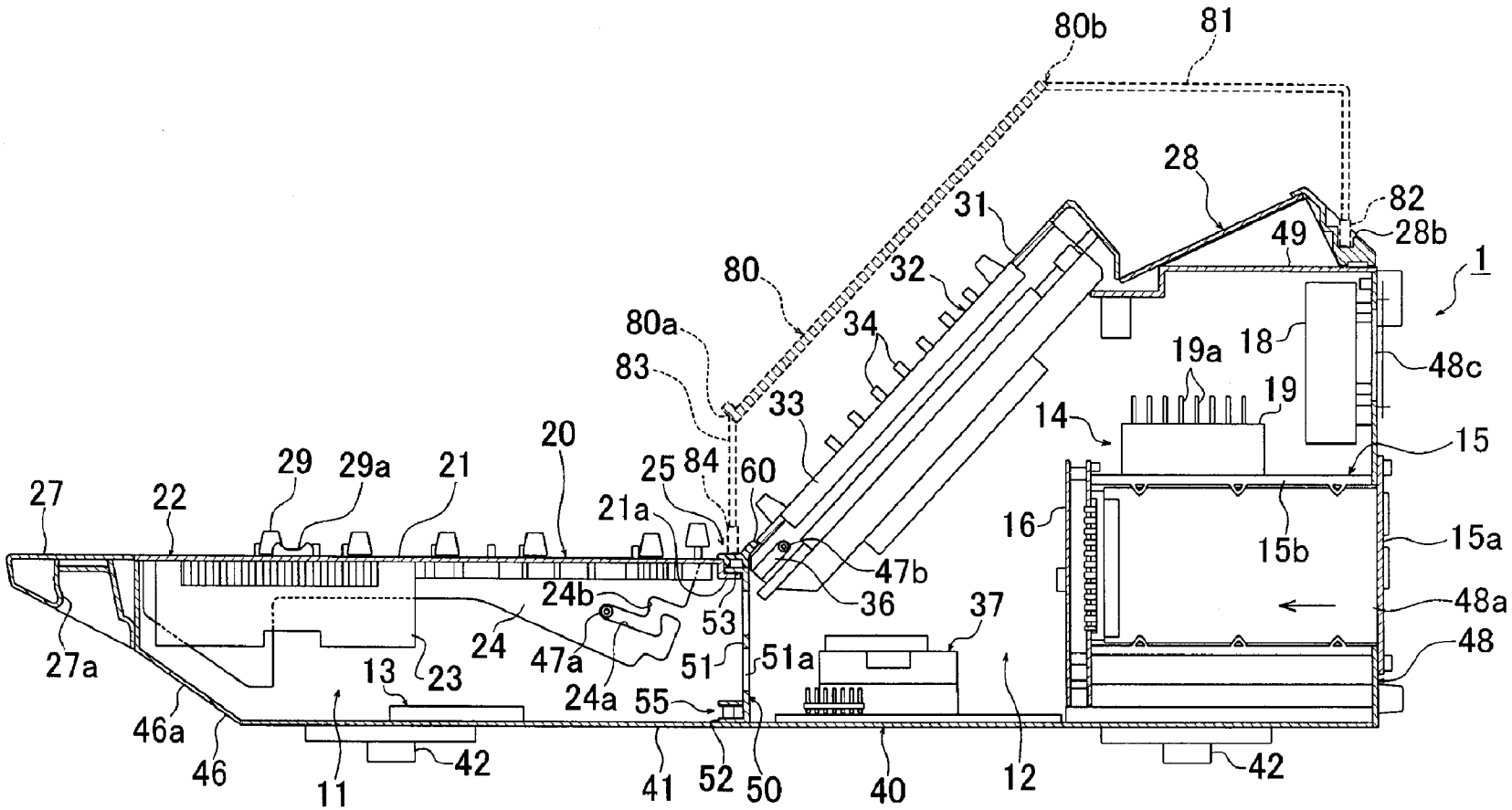
FIG. 3 is a schematic sectional side view of the casing structure of the mixer apparatus.

FIG. 1A is a perspective view showing an outer appearance of a mixer apparatus (sound adjusting apparatus) 1 to which is applied a casing structure according to an embodiment of the present invention, and FIG. 1B is a rear view of the mixer apparatus 1. FIG. 2 is a perspective view showing a casing 10 with an operation panel mounting unit 22 and a display mounting unit 32 removed therefrom. FIG. 3 is a schematic sectional view of the casing 10 of the mixer apparatus 1. In the following description, a side of the mixer apparatus 1 closer to a human operator will be referred to as "front side", a side of the mixer apparatus 1 opposite from the front side will be referred to as "rear side", and a direction between left and right sides as viewed from the front side of the mixer apparatus 1 will be referred to as "left-right horizontal direction".

The casing 10 of the mixer apparatus 1 is generally of a box shape, which includes: an upper surface section 20 on which are provided a display 33 and a plurality of operating members (operators) 29 (29*a*-29*c*); a bottom surface section 40 disposed under the upper surface section 20; and a side surface section 45 surrounding side surfaces connecting between the upper surface section 20 and the bottom surface section 40. The side surface section 45 includes a front wall 46 defining a front side surface of the casing 10, left and right side walls 47 defining left and right side surfaces of the casing 10, and a rear wall 48 defining a rear side surface of the casing 10. An air hole 46*a* in the form of a slit-shaped through-hole or the like is formed in the front wall 46 (see FIG. 3). The bottom surface section 40 has a bottom wall 41 of a flat plate shape, and a plurality of leg portions 42 provided on the underside of the bottom wall 41.

Further, as shown in FIGS. 1 and 2, a pair of side covers 26 are disposed outwardly of the side walls 47, and a front cover 27 is disposed forwardly of the front wall 46. Each of the side covers 26 is shaped to extend along the corresponding side wall 47; that is, each of the side covers 26 has an upper surface portion formed in a substantial obtuse-angled "V" shape extending along the upper surface section 20 and has, in its side surface, a concave grip portion 26 to be gripped by a hand of a human operator. The front cover 27 has an upper surface extending substantially horizontally from the front end edge of the casing 10, and it has concave grip portions 27*a* (see FIG. 3) provided in its lower surface. The side covers 26 and front cover 27 are fixed to the outer surface of the casing 10 by means of not-shown fasteners, such as bolts.

Further, as shown in FIGS. 1 and 3, an upper cover 28 having a generally triangular cross-sectional shape and projecting upward is mounted on a portion of the upper surface section 20 located rearwardly of a display panel 31, i.e. on a rear-end upper portion of the casing 10. A flat small-article placement portion 49 (FIG. 3) extending generally parallel to the bottom wall 41 is provided under the upper cover 28. More specifically, the upper cover 28 is detachably fixed to the small-article placement portion 49 by means of not-shown bolts or the like. When the upper cover 28 is detached from the small-article placement portion 49, small articles, such as a monitoring speaker, letter/character inputting keyboard and a mouse, can be placed on the small-article placement portion 49. Further, the small-article placement portion 49 has a terminal portion 49*a*, comprising for example USB terminals, provided thereon for connection thereto the keyboard and the mouse. Further, the upper cover 28 has an opening 28*a* formed therein in positional correspondence with the terminal portion 49*a*, so that the terminal portion 49*a* is exposed through the opening 28*a*.

The upper surface section 20 includes a generally flat operation panel (operation panel section) 21 disposed on a front side region of the casing 10 and having a multiplicity of the operating members 29 provided thereon, a boundary section 25 located adjacent to the rear end edge 21*a* of the operation panel 21, and the display panel (display panel section) 31 of a generally flat inclined shape extending obliquely, i.e. rearwardly and upwardly, from the boundary section 25 toward the rear of the casing 10 and having the display 33 and a plurality of operating members related to the display 33. The operation panel 21 extends generally in parallel to the bottom wall 41. The boundary section 25 extends straight in the left-right horizontal direction of the casing 10 along the rear end edge 21*a* of the operation panel 21.

In the upper surface section 20, the operation panel 21 and the display panel 31 together define a generally obtuse-angled "V" shape with the boundary section 25 interposed therebetween. Thus, in a state where the casing 10 is installed in place with the bottom wall 40 placed on a horizontal surface (or oriented in the horizontal plane) in a desired installation site, the operation panel 21 lies in the horizontal plane, while the display panel 31 extends rearwardly and upwardly at a predetermined inclination angle (about 45 degrees in the illustrated example) relative to the horizontal plane.

The operation panel mounting unit 22 is provided in a front side region of the upper surface section 20. The operation panel mounting unit 22 includes the operation panel 21 of a generally flay plate shape, side plates 24 (only a rear portion of one of the side plates 24 is shown in FIG. 3) disposed on opposite sides of the operation panel 21, and an operating member (operator) substrate 23 mounted to the underside of the operation panel 21. The various operating members 29 are mounted on the operating member substrate 23 and exposed on the upper surface of the operation panel 21 through small through-holes (not shown) formed in the operation panel 21. The various operating members 29 include fader operators 29*a*, switches 29*b*, rotary volume controls 29*c*, etc. Also, electronic devices, such as a liquid crystal display section 29*d*, are provided on the operation panel 21. The fader operators 29*a* are linearly slidable in the front-rear direction of the mixer apparatus 1. The fader operators 29*a* are constructed to be slidable not only by manual operation of a human operator but also electrically by motors or other drive sources (not shown).

In the instant embodiment of the casing structure of the present invention, where the operation panel 21 is disposed in parallel to the bottom surface section 40, the operation panel 21 lies in the horizontal plane when the mixer apparatus 1 is placed in the horizontal plane. Thus, the fader operators 29*a* are caused to slide in the horizontal plane, so that loads on the motors or other drive sources for driving the fader operators 29*a* can be reduced. As a result, the instant embodiment can not only reduce the necessary motor driving electric power to thereby save power consumption but also permits stable operation of the fader operators 29*a*.

The display mounting unit 32 is provided rearwardly of the upper surface section 20. The display mounting unit 32 includes the display panel 31 of a substantially flat plate shape, and the display 33 fitted in the display panel 31. Operating members (operators) 34 are provided to one side of the display 33.

Figure 4:
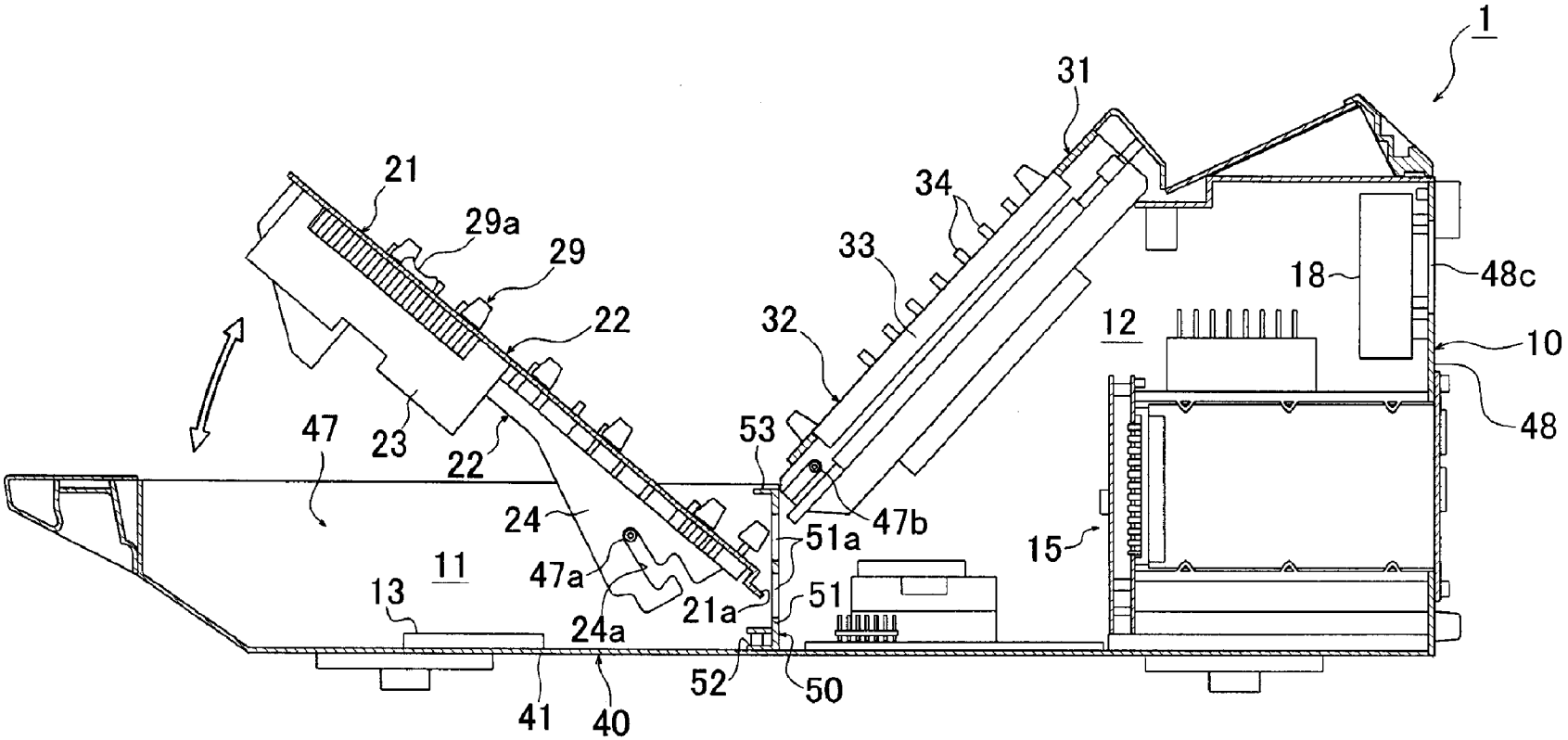
FIG. 4 is a view explanatory of how the operation panel mounting unit is mounted to the casing and of how it behaves.

FIG. 4 is a view explanatory of how the operation panel mounting unit 22 and the display mounting unit 32 are mounted to the casing 10 and of how they operate or behave. The operation panel mounting unit 22 can open and close an upper opening 11*a* of a front accommodating section 11 by vertically pivoting about pivot shaft portions (pivot points) 47*a*. More specifically, a pair of pivot shaft portions 47*a* provided on, and projecting horizontally inwardly from, opposed inner side surfaces of the front accommodating section 11 are held in engagement with a pair of engaging grooves 24*a* formed in the side plates 24 of the operation panel mounting unit 22. Each of the pivot shaft portions 47*a* is in the form of a small projection of a substantially circular columnar shape projecting inwardly of the front accommodating section 11 in the left-right horizontal direction. Each of the engaging grooves 24*a* is a relatively narrow groove extending from the rear end of the corresponding side plate 24 of the operation panel mounting unit 22 toward the front of the side plate 24, and it has a stepped portion 24*b* formed along the way and bent in a generally "N" shape for a purposed to be described later.

With the pivot shaft portions 47*a* inserted and engaged in the corresponding engaging grooves 24*a*, the operation panel mounting unit 22 is vertically pivotable about the pivot shaft portions 47*a* to open or close the upper opening 11*a* of the front accommodating section 11. A state in which the upper opening 11*a* of the front accommodating section 11 is closed with the operation panel mounting unit 22 will be referred to as "closed state" or "closed position", while a state in which the upper opening 11*a* is opened will be referred to as "opened state" or "opened position". The operation panel mounting unit 22 can be detached from the casing 10 by the pivot shaft portions 47*a* being pulled rearwardly along the engaging grooves 24*a* out of the engaging grooves 24*a*. The generally N-shaped stepped portions 24*b* of the engaging grooves 24*a* can prevent the operation panel mounting unit 22 from being accidentally detached from (or slipping out of) the casing 10.

Further, the display mounting unit 32 is mounted as follows. Pivot shaft portions 47*b* provided on inner side surfaces of left and side walls 47 of the casing 10 are inserted and engaged in engaging grooves 36 formed in opposed left and right outer side surfaces of the display mounting unit 32 near the front end of the unit 32. Each of the pivot shaft portions 47*b* is in the form of a small projection of a substantially circular columnar shape projecting horizontally inwardly of the rear accommodating section 12 in the left-right horizontal direction. Each of the engaging grooves 36 is a linear narrow groove extending from the front end of the display mounting unit 36 toward the rear of the display mounting unit 36. With the pivot shaft portions 47*b* engaged in the corresponding engaging grooves 36, the display mounting unit 32 is pivotable vertically (i.e., in the front-rear direction) about the pivot shaft portions 47*b*. Thus, when the display mounting unit 32 is to be mounted to an upper opening 12*a* of the rear accommodating section 12, it can be fitted into the upper opening 12*a* by its rear end being caused to pivot rearwardly.

Within the casing 10, there are provided the front accommodating section 11 defined between the operation panel 21 and the bottom wall 41, and the rear accommodating section 12 defined between the display panel 31 and the bottom wall 41. The front accommodating section 11 is an accommodating space formed under the operation panel 21, in which are accommodated various electronic components, such as the operating member substrate 23 mounted on the underside of the operation panel 21 and a thin, small substrate 13 mounted on the bottom wall 41. Most of the components within the housing 10 are provided or accommodated in the rear accommodating section 12, and thus, there is secured a sufficient space in the front accommodating section 11 such that air flows are not hindered in the interior of the front accommodating section 11.

The rear accommodating section 12 is a space formed under the display panel 31, which has a greater interior height and volume than the front accommodating section 11. The rear accommodating section 12 has an extension board mounting section 15 provided therein for mounting thereto an extension board 15*a*. The extension board mounting section 15 includes a substantially rectangular basket-shaped frame member 15*b* provided in a left rear region of the rear accommodating section 12, and an opening 48*a* formed in the rear wall 48. Further, a circuit board 16 is provided on the front surface of the frame member 15*b*. As shown in the rear view of FIG. 1B, the extension board 15*a* is inserted into the frame member 15*b* through the opening 48*a*, as indicated by a leftward arrow in FIG. 3, to be mounted to the extension board mounting section 15. More specifically, the extension board 15*a* is attached in a vertical orientation with upper end lower edges thereof inserted in slit-shaped inserting channels (not shown) formed in the opposed inner surfaces of upper and lower walls of the frame member 15*b*.

Further, as shown in FIG. 2, a power supply unit 17 is provided in the rear accommodating section 12. The power supply unit 17 is a substantially rectangular box-shaped device provided in a right rear region of the rear accommodating section 12, i.e. to the right of the extension board mounting section 15. As shown in FIG. 1B, a power supply terminal portion 48*b* for connection thereto terminals of a power supply cord is provided on a outer surface portion of the rear wall 48 corresponding in position to the power supply unit 17. Further, an air sucking fan 18 is provided above the extension board mounting section 15 and power supply unit 17. The air sucking fan 18 is fixed to the inner surface of the rear wall 48, and air holes 48*c* are formed in a portion of the rear wall 48 opposed to the air sucking fan 18. Preferably, a plurality of sets of the air sucking fans 18 and air holes 48*c* are arranged in the left-right horizontal direction of the rear wall 48. These air sucking fans 18 and air holes 48*c* can produce air flows in the front and rear accommodating sections 11 and 12.

Further, as shown in FIG. 3, electronic components (heat producing components) 19, such as substrates, which tend to produce a relatively great amount of heat are provided in the rear accommodating section 12 in front of the air sucking fan 18. Radiating fins 19*a* are provided for the electronic components 19 that produce a particularly great amount of heat. Namely, in the embodiment of the mixer apparatus 1, a heat-producing component installation section 14, where are provided heat producing components, such as the electronic components 19 and power supply unit 17, that are major heat producing sources in the interior of the casing 10 is disposed in the rear accommodating section 12.

Figure 5:
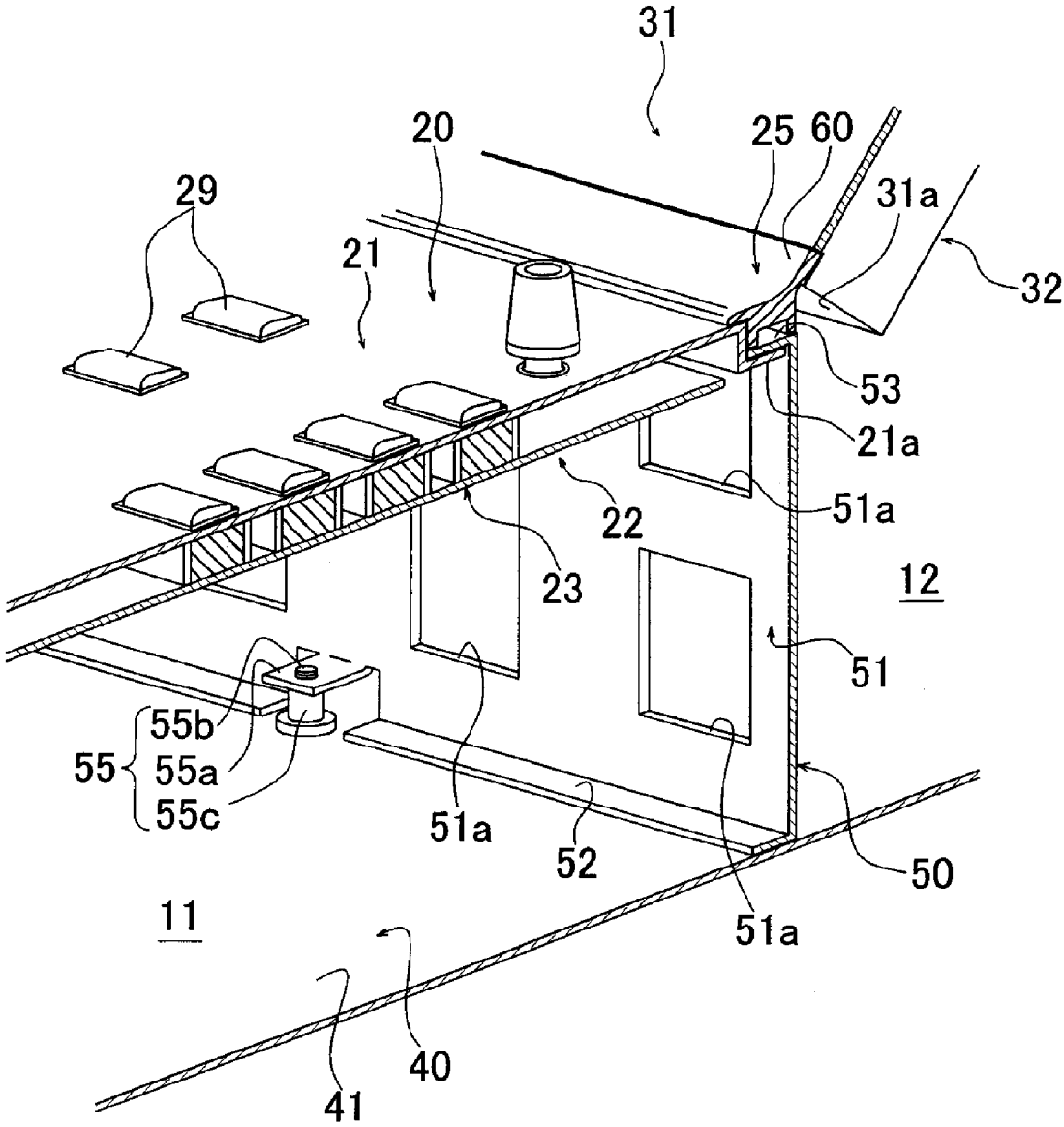
FIG. 5 is a fragmentary enlarged, partly sectional perspective view showing a detailed construction of a boundary section and components around the boundary section in the casing.

FIG. 5 is a fragmentary enlarged, partly sectional perspective view showing detailed constructions of the boundary section 25 and components around the boundary section 25 in the casing 10. In the figure, a partition member 50 and the operation panel 21 are shown in section. The partition member 50 is provided within the casing 10 for partitioning the front and rear accommodating sections 11 and 12 immediately under the boundary section 25. The partition member 50 is a generally rectangular reed-shaped metal plate member that extends in the left-right horizontal direction of the casing 10 along the boundary section 25 to span between the left and right sides of the casing 10 and projects vertically upward from the bottom wall 41 to the boundary section 25. The partition member 50 includes a body portion 51 lying vertical to the bottom wall 41, a lower end edge portion 52 formed by bending a lower end portion of the body portion 51 substantially perpendicularly toward the front side, and an upper end edge portion 53 formed by bending an upper end portion of the body portion 51 substantially perpendicularly toward the front side. The lower end edge portion 52 is fixed to the bottom wall 41, and the upper end edge portion 53 is fixed to the underside of the boundary section 25 and abuts against the rear end edge 21*a* of the operation panel 21. In this manner, the boundary section 25 of the upper surface section 20 is supported from below by the partition member 50 so that the boundary section 25 and components around the boundary section 25 are mechanically reinforced by the partition member 50.

The lower end edge portion 52 of the partition member 50 is fixed to the bottom wall 41 by a fixation section 55. The fixation section 55 includes a fixing portion 55*a* provided higher than the lower end edge portion 52, a spacer member 55*c* of a substantially circular columnar shape interposed between the fixing portion 55*a* and the bottom wall 41, and a bolt 55*b* for fixing the fixing portion 55*a* to the bottom wall 41. The fixing portion 55*a* is a generally tongue-shaped portion projecting in parallel to the lower end edge portion 52 toward the front side from a recess of a substantially inverted "U" formed on a lower end region of the body portion 51. The bolt 55*b* passed through a bolt hole (not shown) of the bottom wall 41 from below is inserted through the spacer member 55*c* to be screwed to the fixing portion 55*a*.

Further, as the operation panel mounting unit 22 is caused to pivot about the shaft portions 47*a* to its closed position as shown in FIG. 4, the rear end edge 21*a* of the operation panel 21 comes to abut against the underside of the upper end edge portion 53 of the partition member 50 and the front surface of the body portion 51. Such abutment permits appropriate positioning of the operation panel 20, i.e. appropriate positioning of the operation panel 20 in the front-rear direction and the rear end of the operation panel 20 in the vertical (up-down) direction.

A multiplicity of openings 51*a* each in the form of a rectangular through-hole are formed through the thickness of the body portion 51 of the partition member 50 partitioning the front and rear accommodating sections 11 and 12. The openings 51*a* are arranged at suitable intervals in a grid pattern. The front and rear accommodating sections 11 and 12 communicate with each other through the openings 51*a*. The multiplicity of openings 51*a* formed in the partition member 50 can promote air flows in the front and rear accommodating sections 11 and 12. Namely, within the casing 10, air, introduced through the air hole 46*a* formed in the front wall 46 of the front accommodating section 11 and through gaps between the operating members 29 on the upper surface section 20 and peripheral edges of not-shown mounting holes having the operating members 29 mounted therein, goes from the front accommodating section 11 into the rear accommodating section 12 and then is discharged through the air holes 48*c*, through operation of the fan 18. Air flows produced in the aforementioned manner can secure a sufficient heat radiation performance of the heat-producing components within the casing 10. In fact, there are also provided wirings for connecting the small substrate 13 provided in the front accommodating section 11 and circuit components 37 (FIG. 3) provided in the rear accommodating section 12, and wirings for connecting the multiplicity of operating members 29 provided on the operation panel 21 and the circuit components 37 provided in the rear accommodating section 12, although not particularly shown. The above-mentioned openings 51*a* formed in the partition member 50 are also used as holes for passage therethrough of the wirings extending between the front accommodating section 11 and the rear accommodating section 12.

Furthermore, a mall plate 60 is mounted on a region of the upper surface section 20 corresponding in position to the boundary section 25. The mall plate 60 is a narrow plate-shaped member formed of a flexible synthetic resin material or the like, and it is fitted in a gap between the rear end edge 21*a* of the operation panel 21 and a front end edge portion of the display panel 31 and covers the upper end edge portion 53 of the partition member 50.

As indicated by broken line in FIG. 3, a placement plate 80 for placing thereon a scrip and the like can be provided over the display panel 31. The placement plate 80 has a rod-shaped rear leg portion 81 connected to the rear end edge 80*b* thereof, and the rear leg portion 81 extends toward the rear of the casing 10 over the display panel 31 and the upper cover 28, bends vertically downward so that a rolling member 82, such as a caster, provided at the lower end of the leg portion 81 engages with a rail groove 28*b* provided in the upper cover 28. The front end edge 80*a* of the placement plate 80, on the other hand, is located immediately over the boundary section 25, and the placement plate 80 has a straight rod-shaped front leg portion 83 extending vertically downward from the front end edge 80*a*. A rolling member 84 provided at the lower end of the front leg portion 83 is placed on the mall plate 60 for rolling movement thereon in a longitudinal direction of the mall plate 60. In the aforementioned manner, the placement plate 80 is disposed over the display panel 31 in parallel to the display panel 31. The placement plate 80 is slidable over the display panel 31 in the left-right horizontal direction of the casing 10 by the lower end of the front leg portion 83 rolling on the mall plate 60 and the lower end of the rear leg portion 81 rolling in the rail groove 28*b* of the upper cover 28. The placement plate 80 is detachably attachable to the mixer apparatus 1.

In the embodiment of the casing structure of the present invention, as described above, the upper surface section 20 of the casing 10 includes the flat operation panel 21 having the multiplicity of operating members 29 provided thereon, the boundary section 25 located adjacent to the rear end edge 21*a* of the operation panel 21, and the flat display panel 31 having the display 33 and extending obliquely upward from the boundary section 25 toward the rear of the casing 10. Thus, the embodiment of the casing structure of the present invention can reduce the thickness of the casing 10, particularly the thickness of the front side region where the flat operation panel 21 is provided, and thus can reduce the volume of the casing 10. Further, because the plate-shaped partition member 50 is provided under the boundary section 25 and supports and reinforces the boundary section 25 from below, the embodiment of the casing structure of the present invention can increase the strength of the casing 10, particularly the strengths of the boundary section 25 and other components around the boundary section 25. Further, because the partition member 50 provided under the boundary section 25 is fixed in such a manner that its surfaces lie perpendicularly to the upper surface section 40, bottom surface section 40 and side surface section 45, the embodiment of the casing structure of the present invention can prevent deformation and distortion of the boundary section 25 and other components around the boundary section 25. Thus, the embodiment of the casing structure of the present invention can effectively prevent the boundary section 25 and other components around the boundary section 25 from being deformed and distorted during transportation of the mixer apparatus 1 having a relatively great weight.

Furthermore, because the display panel 31 is provided at a greater inclination angle than the operation panel 21, the embodiment of the casing structure of the present invention can secure both good operability of the operating members 29 provided on the operation panel 21 and good visibility of the display 33 provided on the display panel 31. As a result, the embodiment of the casing structure of the present invention can significantly enhance the usability of mixer apparatus 1.

Furthermore, because the display panel 31 slants rearwardly and upwardly at a relatively great angle from the height position of the operation panel 21, the rear accommodating section 12 has a greater interior height and hence a greater interior volume than the front accommodating section 11. Thus, with the heat producing components, such as the power supply unit 17, disposed in the rear accommodating section 12 within the casing 10, the embodiment of the casing structure of the present invention can secure a sufficient heat radiation performance of the heat producing components.

Furthermore, the embodiment of the casing structure of the present invention can open and close the upper opening 11*a* of the front accommodating section 11 by pivoting movement of the operation panel mounting unit 22. Thus, the embodiment of the casing structure of the present invention allows the user or human operator to readily access the operating member substrate 23 provided on the underside of the operation panel mounting unit 22 and components accommodated in the front accommodating section 11, and thereby can facilitate maintenance of the mixer apparatus 1.

Although the preferred embodiment of the present invention has been described above, the present invention is not limited to the above-described preferred embodiment and may be variously modified within the scope of the technical idea presented in the specification and drawings and the following claims.

The present application is based on, and claims priority to, Japanese Patent Application No. 2009-012654 filed on Jan. 23, 2009. The disclosure of the priority application, in its entirety, including the drawings, claims, and the specification thereof, is incorporated herein by reference.

What is claimed is:

1. A casing structure for a sound adiustinq apparatus, said casing structure including a box-shaped casing comprising:

an upper surface section having a display and operating members disposed thereon; a bottom surface section; and a side surface section surrounding side surfaces connecting between the upper surface section and the bottom surface section, wherein said upper surface section includes: a generally flat operation panel section that has a multiplicity of the operating members provided on a front side region of said casing; a boundary section that connects from a rear end edge of the operation panel section; and a generally flat, inclined display panel section that extends rearwardly and upwardly from the boundary section at a greater inclination angle than the operation panel section, wherein said casing including in an interior thereof: a front accommodating section defined between the operation panel section and the bottom surface section; a rear accommodating section defined between the display panel section and the bottom surface section; and a plate-shaped partition member that is provided on the bottom surface section to extend vertically upward from the bottom surface section to the boundary section, said partition member having an opening formed therethrough to permit communication between the front accommodating section and the rear accommodating section, wherein said partition member supports the boundary section of said upper surface section from below to reinforce the boundary section and other components around the boundary section, wherein said operation panel section and the operating members provided on said operation panel section are mounted on an operation panel mounting unit disposed on a front side region of said upper surface section, and wherein said operation panel mounting unit is pivotable about a pivot point, located forwardly of the boundary section, to open or close the front accommodating section.

2. The casing structure as claimed in claim 1, wherein a heat-producing component installing section for installing heat producing components within said casing is provided in said rear accommodating section.

3. The casing structure as claimed in claim 1, wherein said operation panel section is disposed generally in parallel to the bottom surface section.

4. The casing structure as claimed in claim 1, wherein, as said operation panel mounting unit is caused to pivot about the pivot point to close said front accommodating section, a rear end edge of said operation panel section abuts against the partition member so that said operation panel mounting unit is positioned in a predetermined closed position.

* * * * *